US008162025B2

(12) United States Patent
Motosko et al.

(10) Patent No.: US 8,162,025 B2
(45) Date of Patent: Apr. 24, 2012

(54) SHUTTER SLAT ASSEMBLY FOR ROLL DOWN STORM SHUTTERS

(76) Inventors: Stephen J. Motosko, Sarasota, FL (US); Stephen Motosko, Sarasota, FL (US)

( * ) Notice: Subject to any disclaimer, the term of this patent is extended or adjusted under 35 U.S.C. 154(b) by 372 days.

(21) Appl. No.: 12/148,867

(22) Filed: Apr. 23, 2008

(65) Prior Publication Data

US 2009/0266497 A1 Oct. 29, 2009

(51) Int. Cl.
*E06B 7/28* (2006.01)
*E06B 7/08* (2006.01)

(52) U.S. Cl. ..... 160/180; 49/92.1

(58) Field of Classification Search ..... 160/133, 160/235, 236, 180, 179; 49/92.1, 413
See application file for complete search history.

(56) References Cited

U.S. PATENT DOCUMENTS 335,354 A * 2/1886 Hayes ..... 49/58
345,693 A * 7/1886 Hayes ..... 49/58
1,352,656 A * 9/1920 Cahill ..... 160/232
1,437,947 A * 12/1922 Probert ..... 160/235
2,208,039 A * 7/1940 Mills ..... 160/133
2,505,155 A * 4/1950 Smith ..... 49/371
2,585,627 A * 2/1952 Cornell et al. ..... 160/180
2,592,888 A * 4/1952 Greegor ..... 160/236
2,621,726 A * 12/1952 Greegor ..... 160/235
2,877,517 A * 3/1959 Graham ..... 49/34
2,954,081 A * 9/1960 Recchione ..... 160/219
3,388,500 A * 6/1968 MacDonald ..... 49/130
3,738,413 A * 6/1973 Frobosilo et al. ..... 160/35
D246,116 S * 10/1977 Beirle ..... D25/49
4,126,173 A 11/1978 Theuerkauff
4,174,580 A * 11/1979 Sanders et al. ..... 40/518
4,175,357 A 11/1979 Goldhaber
4,332,287 A 6/1982 Stolpe
4,345,635 A * 8/1982 Solomon ..... 160/133
4,690,193 A 9/1987 Morrison et al.
4,877,077 A * 10/1989 Ebert ..... 160/236
4,884,616 A * 12/1989 Setele ..... 160/236
4,913,216 A * 4/1990 Lemay ..... 160/236
5,029,628 A * 7/1991 Lemay ..... 160/232
5,095,965 A * 3/1992 Higashiyama ..... 160/133
5,105,870 A * 4/1992 Merjane ..... 160/236
5,141,042 A * 8/1992 Schwaegerle ..... 160/236
5,236,260 A * 8/1993 Yu ..... 312/297
5,269,361 A * 12/1993 Ryden et al. ..... 160/236
5,358,024 A * 10/1994 Schwaegerle ..... 160/236
5,474,118 A * 12/1995 Hoffman ..... 160/235
5,507,335 A * 4/1996 Yu ..... 160/235
5,560,416 A * 10/1996 Yu ..... 160/229.1
5,655,589 A * 8/1997 Vartanian ..... 160/166.1
5,808,816 A * 9/1998 Yu ..... 359/810
5,957,186 A * 9/1999 Boswell ..... 160/201

(Continued)

*Primary Examiner* — Darnell Jayne
*Assistant Examiner* — Jaime F Cardenas-Garcia
(74) *Attorney, Agent, or Firm* — Gifford, Krass, Sprinkle, Anderson & Citkowski, P.C.

(57) ABSTRACT

A shutter slat assembly for a storm shutter, the slat assembly including an elongated horizontally extending shutter slat having longitudinally extending formed edges configured to slidably, interlockingly connect with the next adjacent slat for limited pivotal movement between adjacent connected slats sufficient for rolled-up storage of the storm shutter. Each slat has a central port formed therethrough for viewing and light transmission through the port. An elongated transparent panel preferably having a cross section similar to that of the slat includes enlarged edge portions configured and spaced for dependent slidable engagement between and within inwardly facing grooves formed inwardly adjacent to the edges. The transparent panel covers the port while allowing a person to obtain a view and permit light transmission therethrough.

13 Claims, 3 Drawing Sheets

U.S. PATENT DOCUMENTS

| | | | | |
|---|---|---|---|---|
| 6,041,847 | A | 3/2000 | Lai | |
| 6,095,225 | A * | 8/2000 | Miller | 160/133 |
| 6,189,593 | B1 * | 2/2001 | Katchur et al. | 160/133 |
| 6,263,943 | B1 * | 7/2001 | Lai | 160/133 |
| 7,100,665 | B2 * | 9/2006 | Miller | 160/235 |
| 7,357,171 | B2 * | 4/2008 | Miller | 160/235 |
| 2002/0053411 | A1 * | 5/2002 | Mochizuki | 160/201 |
| 2003/0000164 | A1 * | 1/2003 | Berger, Jr. | 52/208 |
| 2007/0175117 | A1 | 8/2007 | Brown | |
| 2008/0202700 | A1 * | 8/2008 | Miller | 160/133 |

* cited by examiner

SHUTTER SLAT ASSEMBLY FOR ROLL DOWN STORM SHUTTERS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to roll-up shutters for storm and hurricane and security protection, and more particularly to a uniquely configured shutter slat assembly for storm shutters which includes a transparent viewing and light-transmitting portion formed therethrough.

2. Description of Related Art

Roll-up Storm shutters are well known and afford a great deal of window and interior protection from storms, hurricanes and from breaking and entering into a home or building through otherwise unprotected windows and doors. These roll-up shutters are formed of a plurality of interlocking horizontally extending slats which have limited pivotal motion therebetween and are typically arcuately configured in cross section to facilitate the roll-up storage of the storm shutters when not in use.

A significant drawback to such roll-up shutters is that they are traditionally formed of opaque plastic or metal material which does not permit light transmission therethrough. Therefore, when the storm shutters are deployed, the interior of the house or building is darkened substantially and the occupants, if any, cannot easily view the outside of the home or building through the closed and protected windows and doors.

A number of prior art devices related to storm shutters are known to applicant and are adapted to provide some light transmission features as well as to facilitate the exterior viewing by a person within the building as follows:

U.S. Pat. No. 6,263,943 to Lai teaches a modular rolling shutter comprised of vertically alternating rows of buckles and slats. Each slat is linked with the lower and upper buckles, allowing limited movement of the slats and buckles so that the modular shutter may be rolled and unrolled along tracks. The slats may be made of a transparent material allowing visibility without sacrificing weather resistance or security. U.S. Pat. No. 6,041,847 also to Lai discloses a building block for a rolling shutter made of plastic sheets.

A rolling door construction which is easily assembled and which includes a plurality of light-transmitting panels is taught in U.S. Pat. No. 4,332,287 to Stolpe. Snarli teaches a rollable or foldable shutter device for protecting, closing off or partitioning of areas, such as window areas in U.S. Pat. No. 5,456,305. The shutter is provided with panels made from a transparent material, such as polycarbonate, and hinges which are mounted so that it can be folded or rolled up. The hinges and the panels may be made in one piece. When the device is used, at least a part of the transparency remains.

U.S. Pat. No. 4,345,635 to Solomon discloses a rolling protective gate for store fronts or the like which is formed of a series of horizontally-extending transparent slats interconnected and articulated by a series of horizontally-extending metal rods. The transparent slats and metal rods are elongated, and each extends the full width of the building front access opening in which the rolling gate is mounted.

In U.S. Patent Application Publication No. US 2007/0175117, Brown teaches a storm shutter look out portal for storm shutters comprised of an assembly with an interior frame and an exterior frame enclosing at least one transparent panel in between, and also including a cover associated with the interior frame that is moveable from a closed position to an open position where the cover, the interior frame and the exterior frame, are all fabricated from materials that are resistant to the impacts anticipated during a hurricane or tropical storm.

Expired U.S. Pat. No. 4,690,193 to Morrison et al. discloses a rolling shutter characterized by an array of edge-adjacent, parallel shutter slats and full shutter width, clear shutter segments or links articulately interconnecting respective pairs of adjacent shutter slats. When spaced apart, the slats form therebetween a gap which exposes the clear link which permits passage of light over substantially the full extent of the gap. The clear links also provide a double hinge-like joint between adjacent slats.

Goldhaber teaches a protective enclosure for building openings such as windows and doorways wherein the protective enclosure comprises a peripheral frame member that circumscribes the openings and pivotally mounts a transparent shielding unit in U.S. Pat. No. 4,175,357.

A shutter with profiled strips made of transparent plastic is disclosed in U.S. Pat. No. 4,126,173 to Theuerkauff. U.S. Pat. No. 5,507,335 to Yu teaches a shutter with a plurality of slat units which have transparent portions through which an object behind the same can be viewed.

The present invention provides a still further improvement in the configuration of the shutter slat assembly for use in forming a storm shutter for roll-up storage and easy downward deployment. In this invention, an elongated viewing port is formed along each opaque metal or plastic slat which is covered and secured by a mating elongated transparent extruded or molded plastic panel slidably and lockably engaged within inwardly facing grooves formed along the edges of the slat.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a shutter slat assembly for a storm shutter, the slat assembly including an elongated horizontally extending shutter slat having longitudinally extending formed edges configured to slidably, interlockingly connect with the next adjacent slat for limited pivotal movement between adjacent connected slats sufficient for rolled-up storage of the storm shutter. Each slat has a central port formed therethrough for viewing and light transmission through the port. An elongated transparent panel is also provided having a cross section similar to that of the slat and enlarged edge portions configured and spaced for dependent slidable engagement between and within inwardly facing grooves formed inwardly adjacent to the edges. The transparent panel covers the port while allowing a person to obtain a view and permit light transmission therethrough.

It is therefore an object of this invention to provide an improved shutter slat assembly for storm shutters which facilitates outward viewing therethrough and light transmission into the home or building when the storm shutter is deployed for protection.

Still another object of this invention is to provide a shutter slat for storm shutters which includes an easily assemblable two-part structure including a transparent panel which slidably engages into mating groove structure of the slat for economy and strength.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
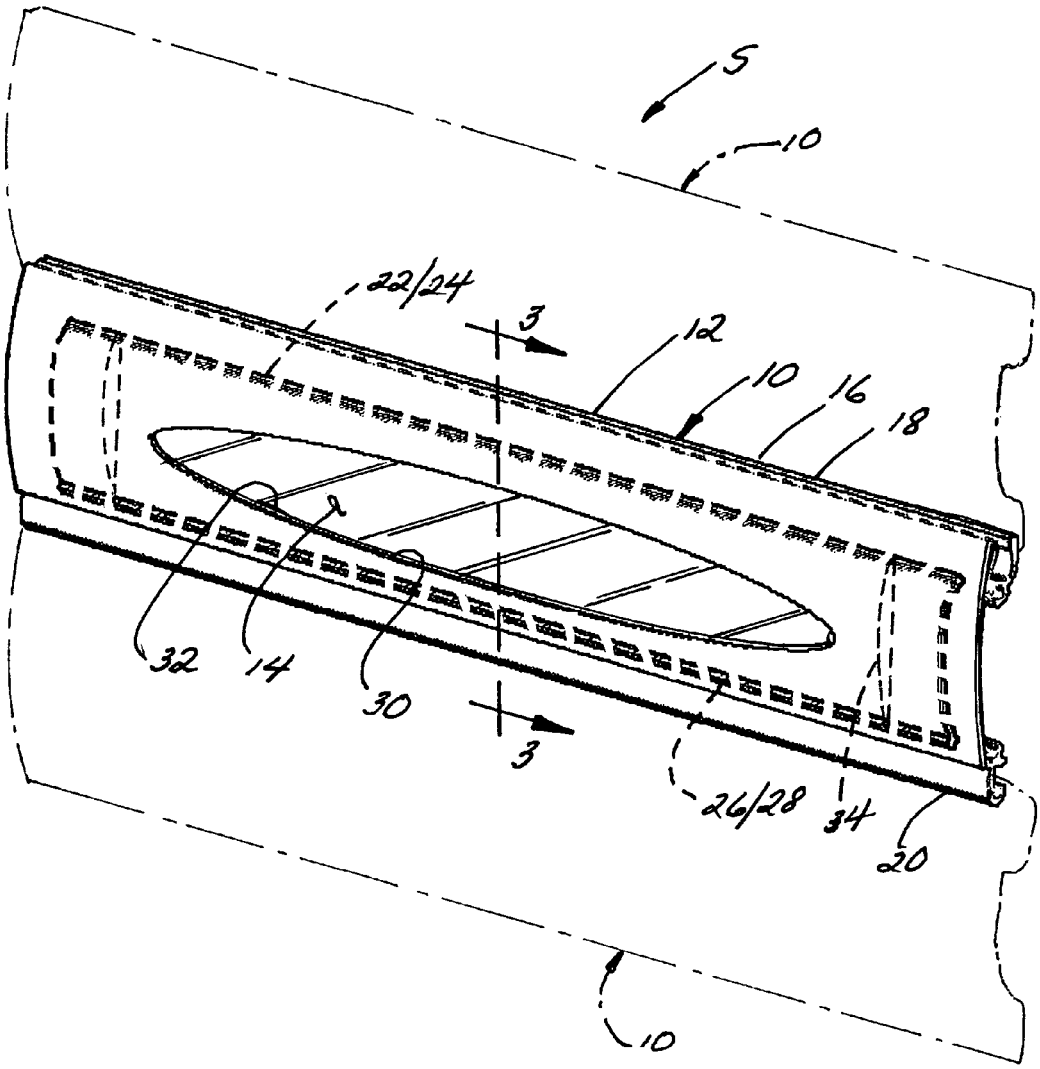
FIG. 1 is a perspective view of a shutter slat assembly 10 showing adjacent such shutter slat assemblies in phantom interengaged to form a storm shutter S.
Figure 3:
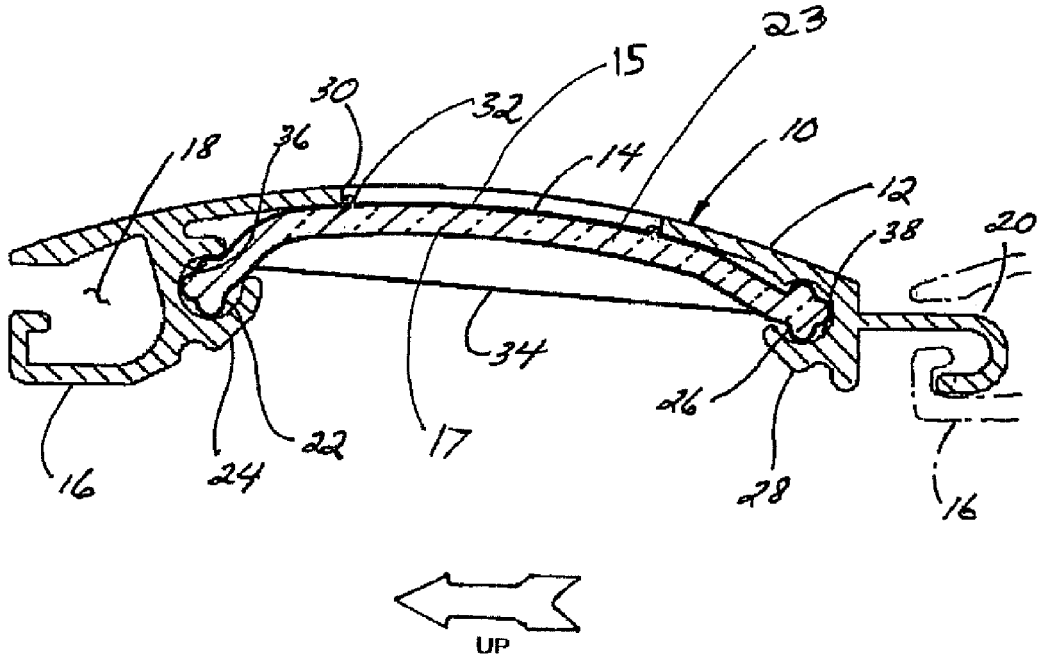
FIG. 3 is a section view in the direction of arrows 3-3 in FIG. 1.
Figure 4:
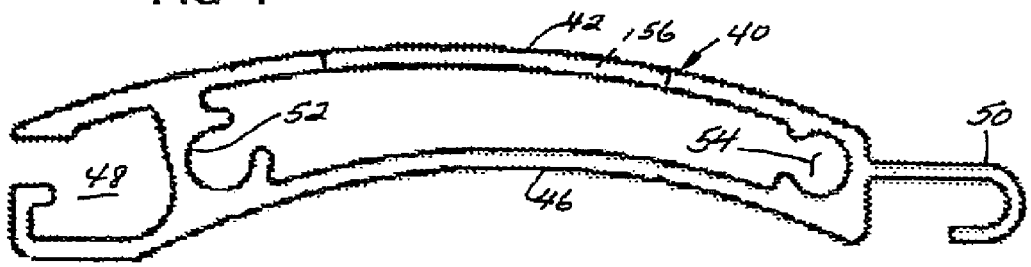
FIG. 4 is an end elevation view of an alternate shutter slat into which the invention may be incorporated.

Referring now to the drawings, the invention is there shown generally at numeral 10 and, in FIG. 1, is shown from the outside in conjunction with other such shutter slat assemblies 10 shown in phantom to form a storm shutter S. The assembly 10 includes an elongated preferably aluminum extruded shutter slat 12 and a generally coextensive transparent molded or extruded plastic panel 14, both of which are arcuate in cross sectional configuration and generally similar to or mating one to another as best seen in FIG. 3.

The shutter slat 12, again formed of extruded aluminum material, includes a first end and an opposite second end, and vertically oriented, outwardly facing edges 16 and 20. Edge 16 defines a channel 18 while edge 20 defines a hook structure which slidably, matably engages as shown in phantom in FIG. 3 with the next adjacent edge 20, and so on, to form the storm shutter S. The outer surface configuration of the shutter slat 12 is preferably arcuately convex and facilitates the rolled up storage configuration of the storm shutter S when not in use. Immediately adjacent to the edges 16 and 20 of the slat 12 are opposing generally inwardly facing grooves 36 and 38, formed by enlargements 26 and 28, the purpose of which will be described herebelow. The grooves 36 and 38 extend from the first end to the second end in a longitudinal direction of the slat 12.

The slat 12 includes an elongated central port 30 formed therethrough which is provided so that a person within a building may view the outside therethrough without having to elevate the storm shutter S. Moreover, the port 30 also provides for light transmission into the building when the shutter S is deployed to illuminate or light the inside of the home or building for those inside.

Figure 2:
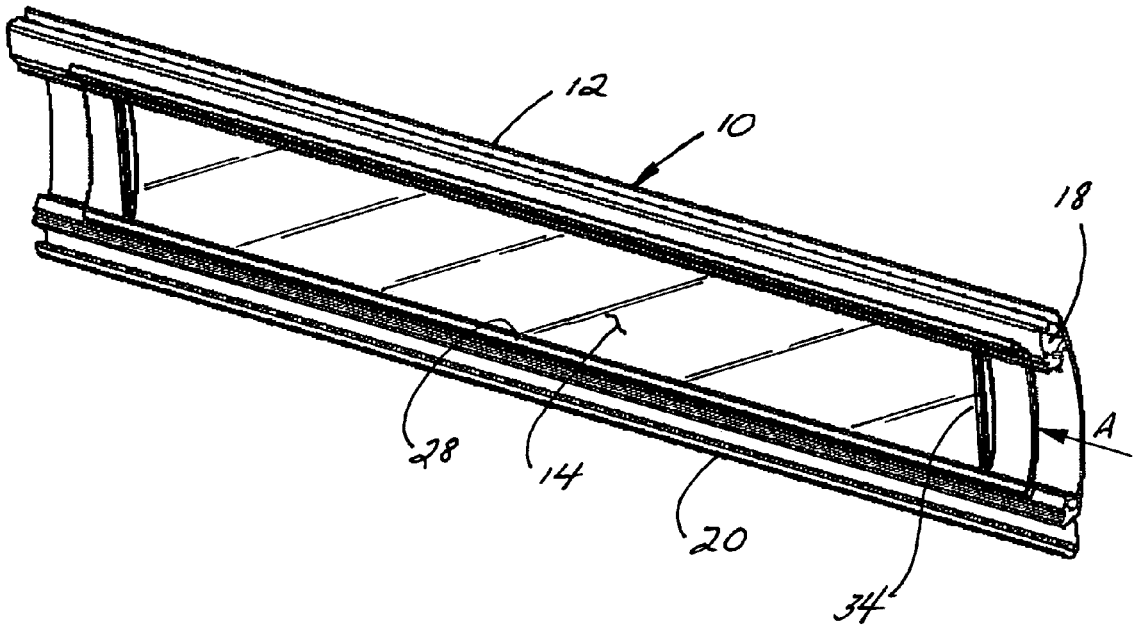
FIG. 2 is a rear perspective view of FIG. 1.

Also included with the slate assembly 10 is an elongated molded transparent panel 14 molded of polycarbonate material and having a central convex arcuate portion 23 which matably fits against the inner concave surface of the slat 12. The transparent panel 14 includes a front surface 15 and a rear surface 17, and a thickness measured as the distance between the front surface 15 and the rear surface 17. The transparent panel 14 further includes longitudinal side edge enlargements 22 and 26 extending between the front surface 15 and the rear surface 17. The side edges 22 and 26 are disposed at either side of the panel 14 in a direction generally transverse to the longitudinal direction of the transparent panel 14, and extend substantially along the longitudinal direction of the panel 14. The side edges 22 and 26 are sized and spaced apart to snugly slidably engage within grooves 36 and 38 when assembled in the direction of arrow A in FIG. 2. This assembly arrangement positions and secures the transparent panel 14 centrally and generally coextensive with the slat 12.

To prevent scratching of the outer convex arcuate surface of the transparent panel 14, a preferably continuous bead 32 is formed on the outer surface of the central portion 23 having a shape which substantially matches and mates into the port 30. The bead 32 being disposed between the side edges 22 and 26 on the outer surface of the central portion 23. As the transparent panel 14 is slidably engaged in the direction of arrow A within grooves 36 and 38, the bead 32 rubs against the inner surface of the slat 12 until the bead 32 snappingly engages into and within port 30 so that, once the transparent panel 14 is thusly installed, removal is difficult at best to secure this arrangement. Any assembly marring only occurs on the crown of the bead 32.

To enhance the storm resistance and impact strength of the assembly 10, the molded transparent panel 14 includes one or more transverse strengthening ribs 34 which are positioned preferably adjacent the ends of the transparent panel 14 but also may be added transversely across the central portion thereof to span the central area of the port 30 for added impact strength in this location.

The important aspects of the present invention may also be incorporated into a shutter slat shown generally at numeral 40 absent the transparent panel 14 previously described. This slat 40 includes spaced double walls 42 and 46 for strength. However, the important aspects of the edge channel 48 and the edge hook 50, along with the inwardly facing or opposing grooves 52 and 54 which receive the edges of the transparent panel as previously described are provided. Moreover, this slat embodiment 40 also includes the port 56 for light transmission and outwardly viewing as previously described.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A shutter slat assembly for a storm shutter comprising:

an elongated horizontally extending shutter slat formed having an arcuate central cross section and first and second cooperatively configured longitudinally extending edges which slidably and interlockingly connect with a next adjacent said slat for limited pivotal movement between adjacent connected said slats sufficient for rolled-up storage of said storm shutter;

said slat having a central port formed therethrough sized for allowing a person to obtain a view through said port, said port disposed between a pair of elongated grooves, formed on said slat, said pair of grooves extending beyond said central port in a longitudinal direction of said slat;

an elongated transparent panel having a front surface and a rear surface, said panel having a central portion having an arcuate cross section similar to that of said slat, said panel having side edge portions disposed at either side of said panel in a direction generally traverse to said longitudinal direction of said panel and which extend between said front surface and said rear surface, said side edge portions having a cross sectional width greater than a thickness of said central portion, said side edge portions extending substantially along a longitudinal length of said transparent panel, said side edge portions are configured and spaced for dependent slidable engagement in said pair of grooves;

said transparent panel covering and substantially sealing said central port while permitting viewing and light transmission therethrough.

2. A shutter slat assembly for a storm shutter comprising:

an elongated horizontally extending shutter slat having first and second longitudinally extending formed edges which slidably and interlockingly connect with a corresponding mating edge of a next adjacent said slat for limited pivotal movement between adjacent connected said slats sufficient for rolled-up storage of said storm shutter;

said slat having a central port formed therethrough for permitting light transmission therethrough;

an elongated transparent panel having enlarged edge portions which are configured and spaced for dependent slidable engagement between and within inwardly facing grooves formed inwardly adjacent said edges of said slat;

said transparent panel tightly covering said port while permitting light transmission therethrough; and an outwardly extending bead formed on an outwardly facing surface of a central portion of said transparent panel, said bead disposed between said enlarged edge portions, said bead sized to space the outer surface of said transparent panel from an inner surface of said slat while said transparent panel is being slidably installed within said slat, said bead also matingly engaging in said port to resist removal of said panel from said slat.

3. The shutter slat of claim 1 wherein the grooves have a generally C-shaped cross section.

4. The shutter slat of claim 1 wherein the grooves are inwardly facing.

5. The shutter slat of claim 1 wherein the slat is formed as an extrusion.

6. The shutter slat of claim 2 wherein the grooves have a generally C-shaped cross section.

7. The shutter slat of claim 2 wherein the grooves are inwardly facing.

8. The shutter slat of claim 2 wherein the slat is formed as an extrusion.

9. A shutter slat for rolled-up storage of a storm shutter assembly, said shutter slat comprising:

an elongated slat member having a first end, an opposite second end, and a first and second longitudinally extending edges, said edges cooperatively configured to interconnect with a next adjacent slat, said slat having a pair of elongated grooves disposed on a rear side of said slat, said pair of grooves extending from said first end to said second end of said slat;

a port formed in said slat and positioned between said grooves;

an elongated transparent panel having a front surface and a rear surface, said panel having a central portion generally conforming to said rear side of said slat; said central portion having a predetermined thickness and a pair of edge portions disposed at either side of said panel in a direction generally traverse to said longitudinal direction of said panel and which extend between said front surface and said rear surface, said pair of edge portions having a cross sectional width greater than the predetermined thickness of the central portion; said pair of edge portions extending substantially along a longitudinal length of said transparent panel, said pair of edge portions formed for slidable engagement with a respective one of said grooves, said central portion of said transparent panel covering and substantially sealing said port while permitting light transmission therethrough.

10. The shutter slat of claim 9 wherein the grooves have a generally C-shaped cross section.

11. The shutter slat of claim 9 wherein the grooves are inwardly facing.

12. The shutter slat of claim 9 wherein the slat is formed as an extrusion.

13. The shutter slat assembly of claim 2, wherein said bead has a shape complimentary to said port such that said bead matingly engages within port to resist removal of said panel from said slat.

* * * * *